US005919749A

United States Patent [19]

Sakamoto et al.

[11] Patent Number: 5,919,749

[45] Date of Patent: Jul. 6, 1999

[54] AMIDE ETHER CARBOXYLATE/AMIDE ETHER DETERGENT COMPOSITION

[75] Inventors: Yuichi Sakamoto; Taeko Hayase; Kazutoshi Ide; Masaki Tosaka; Noriyuki Morii; Tomoko Shibata, all of Tochigi, Japan

[73] Assignee: Kao Corporation, Tokyo, Japan

[21] Appl. No.: 08/563,259

[22] Filed: Nov. 28, 1995

[30] Foreign Application Priority Data

Nov. 28, 1994 [JP] Japan ..... 6-292813
Feb. 15, 1995 [JP] Japan ..... 7-27149

[51] Int. Cl.[6] ..... C11D 1/06; C11D 1/75; C11D 9/00; C11D 3/33

[52] U.S. Cl. ..... 510/499; 510/126; 510/501; 510/502; 510/235; 510/237; 510/119; 510/123; 510/135; 510/129; 510/503; 550/124; 550/130; 550/137; 514/852

[58] Field of Search ..... 510/126, 501, 510/502, 235, 237, 119, 123, 135, 129, 503; 550/124, 130, 137; 514/852

[56] References Cited

U.S. PATENT DOCUMENTS 4,783,282 11/1988 Smid ..... 252/546
4,818,440 4/1989 Schafer et al. ..... 252/546
4,865,757 9/1989 Singh-Verma et al. ..... 252/117
5,415,814 5/1995 Ofasu-Asante et al. ..... 252/558

FOREIGN PATENT DOCUMENTS 620269 4/1994 European Pat. Off. .
0620269 10/1994 European Pat. Off. .

*Primary Examiner*—Douglas J. McGinty
*Assistant Examiner*—Charles Boyer
*Attorney, Agent, or Firm*—Birch, Stewart, Kolasch and Birch, LLP

[57] ABSTRACT

A detergent composition, which exerts sufficient detergency and foaming power even in the presence of oily stains comprising an amide ether carboxylate component (a) and an amide ether component (b), wherein the weight ratio of the content of the component (a) to the content of the component (b) is from 0.1 to 100; the molar ratio of the total divalent metal salt ions (X) in the whole composition and to total anionic surfactants (Y) including the component (a) is from 0.025 to 10; and the composition contains substantially no glycerol or glycerol ether component (z) or the content of said component (z) is not more than 10% by weight based on the sum of the contents of the components (a), (b) and (z) as defined in the specification.

11 Claims, No Drawings

AMIDE ETHER CARBOXYLATE/AMIDE ETHER DETERGENT COMPOSITION

FIELD OF THE INVENTION

This invention relates to a detergent composition. More particularly, it relates to a detergent composition which contains an amide ether carboxylate, an amide ether and a divalent metal salt optionally together with a small amount of glycerol or a specific glyceryl ether and is excellent in foaming power and feel in use and mild to the skin.

BACKGROUND OF THE INVENTION

With the recent growing tendency toward products safe to human body, various attempts have been made to relieve the actions on the skin of detergents which continuously or frequently come into contact directly with human body (for example, laundry detergents, dishwashing detergents, household detergents, hair shampoos and body cleansers). For example, there have been proposed a method which comprises regulating the pH value of a detergent composition to a weakly acidic level (pH 5 to 6) close to the pH value of human skin to thereby relieve its actions and another method which comprises using a main detergent base having an irritativeness as low as possible.

As such a low-irritative detergent base, there have been used amino acid surfactants and alkylphosphoric acid surfactants (JP-B-50-40125, JP-B-55-90335, JP-B-58-27319, etc.; the term "JP-B" as used herein means an "examined Japanese patent publication").

Although these surfactants are less irritative, they have some troubles. That is to say, they cannot always exert a sufficient detergency and foaming power when employed alone. Further, they are poor in solubility.

Regarding dishwashing detergents, it has been widely known that sodium alkylbenzenesulfonates are usable as a base with excellent detergency. However, these sodium alkylbenzenesulfonates have a disadvantage that they seriously reduce the sebum and thus cause hand skin chapping.

In recent years, therefore, dishwashing detergents containing sodium alkylethoxysulfates, which are leas irritative to the skin, as the main detergent base are employed predominantly. Moreover, these detergent bases are used together with auxiliary surfactants (for example, tertiary amine oxides, higher fatty acid diethanolamides) so as to improve the properties and establish milder actions on the skin.

Although the actions of various detergents have been relieved as discussed above, the mildness still remains unsatisfactory at present. In addition, each detergent exhibits a serious slippery feeling in use, thus giving an unpleasantness.

On the other hand, it has been known that alkylglycosides, which are less irritative sugar derivative surfactants, can not only foam per se in a stable state but also serve as a foaming stabilizer for other anionic surfactants, though they are nonionic surfactants. Thus these alkylglycosides have recently attracted public attention (JP-A-58-104625, JP-A-58-186429 and JP-A-64-69695; the term "JP-A" an used herein means an "unexamined published Japanese patent application").

The surfactant compositions and detergent compositions described in these publications are superior in various performances to the conventional ones comprising, polyoxyethylene alkyl ethers as the main base. However they have a problem that the mildness to the skin still remains unsatisfactory.

In particular, the combined use of alkylglycosides with anionic surfactants (for example, those having sulfate or sulfonate groups such as alkylbenzenesulfonates, α-olefinesulfonates, alkylsulfates, alkylethoxysulfates and α-sulfo fatty acid ester salts) is preferable from the viewpoints of detergency, foaming power and cost. In such a case, however, there inevitably arises a problem of the reduction in mildness to the skin.

The reduction in mildness to the skin, which is seemingly caused by the accelerated denaturation of proteins constituting the skin, has been regarded as a serious problem.

Although these alkylglycosides are excellent in foaming power, they give a strongly squeak feel in washing and rinsing, which brings about another technical problem that they cannot be easily employed in shampoos, etc. at the present stage.

On the other hand, amide ether carboxylates, which are known as less irritative surfactants, are marketed by CHEM-Y (Germany) under a trade name "AKYPO", Different from the alkylglycosides, these amide ether carboxylates give no squeak feel in use. However they have a serious slippery feeling characteristic to anionic surfactants. When employed in dishwashing detergents, therefore, these amide ether carboxylates make it difficult to wash dishes due to the slippery feeling. That is to say, they cannot not always give a satisfactory feel in use. Furthermore, such an amide ether carboxylate is poor in foaming power when used alone. Because of these characteristics, these amide ether carboxylates are used in detergents only as auxiliary surfactants.

Examples of known techniques relating to the application of amide ether carboxylate surfactants to detergents include a cosmetic composition containing an amide ether carboxylate (European Patent No. 102118), a detergent composition wherein an amide ether carboxylate surfactant is used together with a polyoxyethylene alkylsulfate (European Patent No. 215504), an amide ether carboxylic acid obtained from fat and a detergent containing the same (JP-B-63-291996, European Patent No. 219893) and a detergent containing a soap as the main component together with an amide ether carboxylic acid and an alkyl ether carboxylic acid salt (U.S. Pat. No. 4,865,757). However none of these detergents is satisfactory from the viewpoint of foaming power.

On the other hand, a detergent containing an amide ether carboxylic acid and magnesium salt was described in European Patent No. 620269. However, the amide ether carboxylic acid used in the patent contains no or merely glycerol derivative. Further, the foaming power and stability of the detergent were remarkably deteriorated since this detergent contained glycerol or glyceryl ether in an amount of about 40% which is different from the composition of the present invention.

Accordingly, an object of the present invention is to provide a detergent composition having a high mildness, a good feel and high stability in use which exerts a sufficient detergency and foaming power even in the presence of a large amount of oily stains and yet causes little denaturation of skin proteins.

The present inventors have paid their attention to the high mildness of amide ether carboxylates to the skin and conducted extensive studies in order to overcome the disadvantages of the same. As a result, they have successfully found out that the above-mentioned object can be achieved by a detergent composition which contains a specific amide ether carboxylate, a specific amide ether and a specific divalent metal salt ion at a specific ratio but substantially no or little glycerol or a specific glyceryl ether.

SUMMARY OF THE INVENTION

The present invention, which has been completed based on the above-mentioned finding, provides a detergent composition containing the following components (a) and (b), wherein the weight ratio of the content of the component (a) to the content of the component (b) [(a)/(b)] is from 0.1 to 100; the molar ratio of the total divalent metal salt ions (X) in the whole composition to the total anionic surfactants (Y) including the component (a) (X/Y) is from 0.025 to 10; and the composition contains substantially no component (z) as specified below or the content of said component (z) is not more than 10% by weight based on the sum of the contents of the components (a) and (b):

(a) an amide ether carboxylate represented by the following formula (I):

(I)

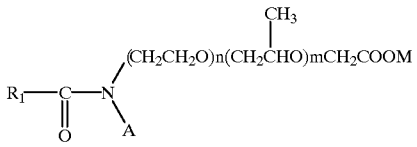

wherein $R_1$ represents a linear or branched alkyl or alkenyl group having 5 to 21 carbon atoms; n and m represent respectively the average degrees of polymerization, provided that they satisfy the formula $1 \leqq n+m \leqq 20$, and when m and n is respectively not 0, the copolymerization form of $(CH_2CH_2O)$ and

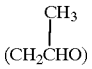

is random, block or alternating; A represents

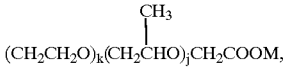

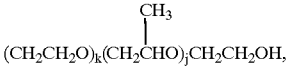

a hydrogen atom, or an alkyl group having 1 to 3 carbon atoms, wherein k and j each represents an average degree of polymerization of from 0 to 20, provided that they satisfy the formula $0 \leqq k+j \leqq 20$, and when k and j is respectively not 0, the copolymerization form of $(CH_2CH_2O)$ and

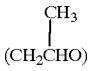

is random, block or alternating; and M represents an alkali metal, an alkaline earth metal, ammonium, an alkanolammonium or a basic amino acid, and

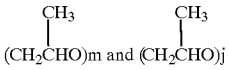

may represent respectively propyleneoxy or polypropyleneoxy group when m and j is respectively not 0, and the methyl group can be bonded at the 2-position in place of 1-position of the ethoxy unit;

(b) an amide ether represented by the following formula (II):

(II)

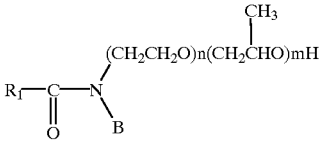

wherein B represents

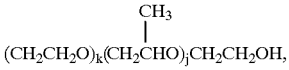

a hydrogen atom or an alkyl group having 1 to 3 carbon atoms, wherein $R_1$, n, m, k and j are each an defined above, and when m and n is respectively not 0, the copolymerization form of $(CH_2CH_2O)$ and

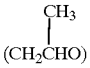

is random, block or alternating, and in the above formulae (I) and (II), $R_1$, n, m, k and j may be either the same or different, and

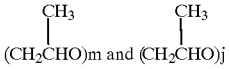

may represent respectively propyleneoxy or polypropyleneoxy group when m and j is respectively not 0, and the methyl group can be bonded at the 2-position in place of 1-position of the ethoxy unit; and (z) glycerol or a glyceryl ether represented by the following formula (III):

(III)

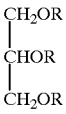

wherein R represents a hydrogen atom, $—(CH_2CH_2O)_pCH_2COOM$ or $—(CH_2CH_2O)_qH$ and three Rs in a molecule may be either the same or different, wherein p and q may be either the same or different and each represents a number of 1 to 20, and M represents a hydrogen atom, an alkali metal, an alkaline earth metal, ammonium, an alkanolammonium or a basic amino acid.

DETAILED DESCRIPTION OF THE INVENTION

Now, the detergent composition of the present invention will be described in greater detail.

The amide ether carboxylate represented by the above-mentioned formula (I), which is to be used as the component (a) of the present invention, is employed in order to improve the mildness to the skin.

Preferable examples of the alkyl or alkenyl group represented by $R_1$ in the above formula (I) include alkyl groups, still preferably linear alkyl groups. From the viewpoints of solubility, foaming power and detergency, those having 9 to 17 carbon atoms, in particular, 10 to 14 carbon atoms are still preferable therefor. From the viewpoint of foaming power, n preferably ranges from 1 to 7, still preferably from 2 to 5 and particularly preferably from 2 to 3. From the viewpoint of foaming power, m preferably ranges from 0 to 5, particularly preferably from 0 to 2, most preferably 0. From the viewpoint of foaming power, it is particularly preferable that A is a hydrogen atom. From the viewpoint of foaming power, k in the group represented by A preferably ranges from 0 to 5 while j preferably ranges from 0 to 2, particularly preferably 0. Preferable examples of M include alkali metals such as sodium and potassium, alkaline earth metals such as magnesium and calcium, alkanolammoniums such as monoethanolammonium ($HOCH_2CH_2NH_3^+$), diethanolammonium ($(HOCH_2CH_2)_2NH_2^+$) and triethanolamnonium ($(HOCH_2CH_2)_3NH^+$, and basic amino acids such as lysine and arginine. Among all, alkaline earth metals, in particular, magnesium and calcium are preferable, magnesium is more preferable therefor.

In the composition of the present invention, the content of the above-mentioned component (a) preferably ranges from 3 to 70% by weight, still preferably from 5 to 40% by weight, from the viewpoint of foaming power and manufacture.

The amide ether represented by the above-mentioned formula (II), which is to be used as the component (b) in the present invention, is used as a foaming agent.

Preferable examples of the alkyl or alkenyl group represented by $R_1$ in the above formula (II) include alkyl groups, still preferably linear alkyl groups. From the viewpoints of solubility, foaming power and detergency, those having 9 to 17 carbon atoms, in particular, 10 to 14 carbon atoms are still preferable therefor. From the viewpoint of foaming power, n preferably ranges from 1 to 7, still preferably from 2 to 5. From the viewpoint of foaming power, m preferably ranges from 0 to 5, particularly preferably from 0 to 2, most preferably 0. From the viewpoint of foaming power, it is particularly preferable that B is a hydrogen atom. From the viewpoint of foaming power, k in the group represented by B preferably ranges from 0 to 5, still preferably from 0 to 2, most preferably 0, while j preferably ranges from 0 to 2.

In the composition of the present invention, the content of the above-mentioned component (b) preferably ranges from 1 to 70% by weight, still preferably from 3 to 40% by weight, from the viewpoint of foaming power and manufacture.

The weight ratio of the content of the above-mentioned component (a) to the content of the above-mentioned component (b) [(a)/(b)] ranges from 0.1 to 100, preferably from 0.1 to 20, still preferably from 0.1 to 10, the most desirably from 0.5 to 3. When this weight ratio is smaller than 0.1, the composition exhibits a slippery feeling. It is not preferable that the weight ratio exceeds 100, since only an insufficient foaming power can be achieved in such a case.

The sum of the contents of the above-mentioned components (a) and (b) [(a)+(b)] preferably ranges from 1 to 80% by weight, still preferably from 5 to 40% by weight, from the viewpoint of foaming power and manufacture.

The amide ether carboxylate to be used as the above-mentioned component (a) in the present invention, which will be sometimes referred to simply as an "amide ether carboxylate (a)", can be produced by, for example, reacting a fatty acid lower alcohol ester (for example, fatty acid methyl ester) employed as a starting material with an alkanolammonium and then converting the obtained product into a polyoxyethylane or polyoxypropylene compound from ethyleneoxide or propyleneoxide, followed by carboxymethylation with the use of a haloacetic acid, etc. A mixture of the above-mentioned components (a) and (b), which will be sometimes referred to simply as an "amide ether derivative mixture", may be prepared by an arbitrary method without restriction. Namely, it can be prepared by directly reacting some portion of the amide ether to be used as the above-mentioned component (b), which will be sometimes referred to simply as an "amide ether (b)", with a haloacetic acid. Alternatively, the above-mentioned amide ether (b) may be added to the above-mentioned amide ether carboxylate (a).

The above-mentioned amide ether (b), which is an intermediate in the production of the above-mentioned amide ether carboxylate (a), can be synthesized by, for examples reacting a fatty acid lower alcohol ester such as a fatty acid methyl ester employed as a starting material with an alkanolammonium followed by the conversion into a polyoxyethylene or polyoxypropylene compound from ethyleneoxide or propyleneoxide. Among these methods, a preferable one comprises using a fatty acid lower alcohol ester such as a fatty acid methyl ester as the starting material, since the product thus obtained is scarcely colored and substantially free from glycerol or glycerol derivatives, i.e., impurities.

Another method for synthesizing the above-mentioned amide ether (b) comprises reacting a fat having the coconut oil fatty acid composition, which is used as a starting material, directly with an alkanolammonium followed by the conversion into a polyoxyethylene or polyoxypropylene compound from ethyleneoxide or propyleneoxide. In this case, glycerol or glyceryl ethers represented by the following formula (III) [the component (z)] originating in the fat are formed in a large amount, which brings about a decrease in the yield of the above-mentioned component (b) and, in its turn, a decrease in the yield of the above-mentioned component (a). Thus this method is not a preferable one. In the method for producing the above-mentioned amide ether derivative mixture, the ratio of the amide ether carboxylate (a) to the amide ether (b) in the obtained amide ether derivative mixture can be controlled by appropriately selecting the molar ratio in the reaction between the amide ether (b) and a monohaloacetic acid, etc. and the reaction conditions including the mixing procedure.

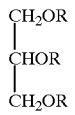

(III)

wherein R represents a hydrogen atom, $—(CH_2CH_2O)_pCH_2COOM$ or $—(CH_2CH_2O)_qH$ and three Rs in a molecule may be either the same or different, wherein p and q may be either the same or different and each represents a number of 1 to 20, and M represents a hydrogen atom, an alkali metal, an alkaline earth metal, ammonium, an alkanolammonium or a basic amino acid.

The detergent composition of the present invention is substantially free from glycerol or a glyceryl ether represented by the formula (III), namely, the above-mentioned component (z) or, alternatively, it contains the glycerol or glyceryl ether in a content of not more than 10% by weight, preferably not more than 5% by weight and still preferably 0% by weight (i.e., substantially no content) based on the sum of the contents of the components (a) and (b). When the content of the above-mentioned glycerol or glyceryl ether exceeds 10% by weight, the foaming power of the composition is largely deteriorated and, in the case of a liquid detergent, the low temperature stability is considerably lowered.

The detergent composition of the present invention is substantially no component (w) as specified below or the content of said component (w) is not more than 10% by weight based on the sum of the contents of the components (a) and (b):

(w) a glyceryl ether represented by the following formula (IV):

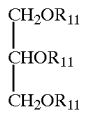

(IV)

wherein $R_{11}$ represents a hydrogen atom,

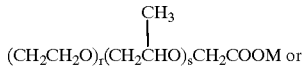

or

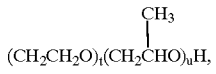

and three $R_{11}$s in a molecule may be either the same or different provided that three $R_{11}$s may not be hydrogen atoms simultaneously, wherein r, s, t and u each represents a number which satisfy the formulae $s \neq 0$, $u \neq 0$, $1 \leqq r+s \leqq 20$ and $1 \leqq t+u \leqq 20$, the copolymerization form is random, block or alternating, an M represents a hydrogen atom, an alkali metal, an alkaline earth metal, ammonium, an alkanolammonium or a basic amino acid, and

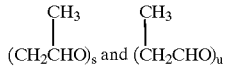

may represent respectively propyleneoxy or polypropyleneoxy group, and the methyl group can be bonded at the 2-position in place of 1-position of the ethoxy unit.

Further, for example, the glyceryl ether of the component (w) represented by formula (IV) derived from oil and fat is formed in the method wherein alkanolammonium is directly reacted with oil and fat consisting of coconut fatty acid as the starting material followed by convertion into polyoxypropylene compound, or polyoxyethylene and polyoxypropylene compound. As the result, the yields of the above-mentioned components (a) and (b) are lowered. Therefore, the detergent composition of the present invention is substantially free from the glyceryl ether represented by the formula (IV), namely, the above-mentioned component (w) or, alternatively, it contains the glyceryl ether and the above-mentioned component (z) in a content of not more than 10% by weight, preferably not more than 5% by weight and still preferably 0% by weight (i.e., substantially no content) based on the sum of the contents of the components (a) and (b). When the sum of the contents of the components (w) and (z) exceeds 10% by weight, the foaming power of the composition is largely deteriorated and, in the case of a liquid detergent, the low temperature stability is considerably lowered.

The amide ether carboxylate of the above-mentioned component (a) is exemplified by a commercially available product AKYPO manufactured by CHEM-Y in Germany. However, this product cannot be used in the present invention, since it contains about 40% of glycerol or glyceryl ethers due to the production method of the same.

The divalent metal salt is used in the present invention in order to suppress a slippery feeling and improve the feel in use. The metal salt of the present invention may be exists from the beginning as the counter ion of the amide ether carboxylic acid. Alternatively, it may be added at the step of the formulation into a detergent.

Examples of the above-mentioned divalent metal salt include inorganic salts of alkaline earth metals. It is preferable to use a water soluble magnesium salt or a water soluble calcium salt (magnesium chloride, magnesium sulfate, magnesium iodide, magnesium nitrate, magnesium bromide, calcium chloride, calcium iodide, calcium bromide, calcium nitrate, etc.) therefor from the viewpoints of solubility and storage stability. Among them, a water soluble magnesium salt is more preferable. In particular, magnesium chloride, magnesium sulfate and calcium chloride are preferable therefor. Among them, magnesium chloride and magnesium sulfate are most preferable. Either one of these divalent metal salts or a mixture thereof may be used.

The content of the above-mentioned divalent metal salt in the composition of the present invention preferably ranges from 0.05 to 40% by weight, still preferably from 0.1 to 10% by weight from the viewpoint of feeling and solubility of the composition.

The molar ratio of the total divalent metal salt ions (X) in the whole composition of the present invention to the total anionic surfactants (Y) including the component (a) (X/Y) is from 0.025 to 10, preferably from 0.05 to 1. When the above-mentioned molar ratio is smaller than 0.025, the composition exhibits a slippery feeling. On the other hand, it is not preferable that this molar ratio exceeds 10. This is because the production of the composition becomes difficult or, in the case of a liquid detergent, the stability of the solution is deteriorated in such a case.

The amide oxide represented by the following formula (V) or (VI), which in the component (c) to be used in the present invention, is employed in order to lower the interfacial tension of a stain to thereby enhance the detergency, in particular, on the surface of a hydrophobic material such as plastics.

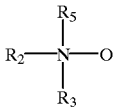

(V)

-continued (VI)

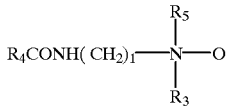

wherein $R_2$ represents an alkyl or alkenyl group having 8 to 22 carbon atoms; $R_5$ and $R_3$ may be either the same or different and each represents an alkyl or alkenyl group having 1 to 5 carbon atoms and optionally carrying hydroxyl group(s); $R_4$ represents an alkyl or alkenyl group having 7 to 21 carbon atoms; and 1 is a number of from 1 to 5.

From the viewpoint of lowering interfacial tension, preferable examples of the alkyl or alkenyl group represented by $R_2$ in the above formulae (V) and (VI) include alkyl groups having 12 to 14 carbon atoms. From the viewpoint of solubility, a methyl group is preferable as the alkyl group optionally carrying hydroxyl group(s) represented by $R_5$ and $R_3$. From the viewpoint of lowering interfacial tension, preferable examples of the alkyl or alkenyl group represented by $R_4$ include alkyl groups having 11 to 15 carbon atoms. From the viewpoint of solubility, 1 is preferably 3.

The content of the above-mentioned component (c) in the composition of the present invention preferably ranges from 1 to 10% by weight, still preferably from 2 to 8% by weight. When the content of the component (c) is smaller than 1% by weight, no sufficient detergency can be obtained in some cases. On the other hand, it is not preferable that this content exceeds 10% by weight, since the resulting composition becomes highly irritative and sometimes causes hand skin chapping.

In order to elevate the emulsifying power of the composition to thereby improve its detergency against oily stains, the composition of the present invention may further contain, as the component (d), one or more nonionic surfactants selected from among a group consisting of: (1) polyoxyethylene (average number of moles added: 2 to 15) alkyl or alkenyl (linear or branched, number of carbon atoms 8 to 18) ethers; (2) fatty acid (number of carbon atoms: 8 to 18) monoethanolamides and fatty acid (number of carbon atoms: 8 to 18) diethanolamides; (3) sugar ester surfactants comprising monoalkyl ethers of fatty acids having 6 to 18 carbon atoms with monosaccharides having 5 to 6 carbon atoms and esters of fatty acids having 6 to 18 carbon atoms with sugars; and (4) sugar amides represented by the following formula (VII):

(VII)

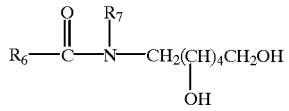

wherein $R_6$ represents an alkyl group having 5 to 17 carbon atoms; and $R_7$ represents a hydrogen atom or an alkyl group having 1 to 4 carbon atoms.

Preferable examples of the above-mentioned polyoxyethylene alkyl ether (1) include compounds having an average number of moles added of from 2 to 15 (preferably from 3 to 7) and having a linear or branched chain with 8 to 18 (preferably from 12 to 16) carbon atoms. Still preferable examples thereof are narrow polyoxyethylene alkyl ethers (i.e., compounds having a narrow distribution of the number of moles of ethylene oxide added) which are represented by the following formula (VIII), contain not more than 10% by weight of an unreacted alcohol (i.e., the component of n=0 in the formula) and satisfy the following numerical formula 1.

$$R_8—O(CH_2CH_2O)nH \quad \text{(VIII)}$$

wherein $R_8$ represents an alkyl or alkenyl group having 8 to 18 carbon atoms; and n (i.e., number of moles of ethylene oxide added) is from 2 to 15.

[Numerical formula 1]

$$\sum_{i=n_{max}-2}^{i=n_{max}+2} Y_i \geq 55\% \text{ by weight}$$

wherein $Y_i$ represents the content (% by weight) of a compound having the number of moles added of i, provided that the number of moles added of the compound of the largest content is referred to as $n_{max}$.

The fatty acids constituting the above-mentioned fatty acid (number of carbon atoms: 8 to 18) monoethanolamides and fatty acid (number of carbon atoms: 8 to 18) diethanolamides (2) may be either saturated or unsaturated, and either liner or branched ones. Particular examples thereof include caprylic acid, capric acid, lauric acid, myristic acid, palmitic acid, stearic acid, caproleic acid, lauroleic acid, myristoleic acid, palmitoleic acid, oleic acid and methylundecanoic acid. Among all, lauric acid and myristic acid are preferable therefor.

In the above-mentioned sugar ester surfactants comprising monoalkyl ethers of fatty acids having 6 to 18 carbon atoms with monosaccharides having 5 to 6 carbon atoms and esters of fatty acids having 6 to 18 carbon atoms with sugars (3), the fatty acids having 6 to 18 carbon atoms in the above-mentioned sugar ester surfactant and the above-mentioned esters of fatty acids with sugars are either saturated or unsaturated, and either linear or branched ones. Particular examples thereof include caproic acid, caprylic acid, capric acid, lauric acid,, myristic acid, palmitic acid, stearic acid, caproleic acid, lauroleic acid, myristoloic acid, palmitoleic acid, oleic acid and methylundecanoic acid. Among all, lauric acid, myristic acid and palmitic acid are preferable therefor.

Examples of the monoalkyl ethers of monosaccharides having 5 to 6 carbon atoms in the above-mentioned sugar ester surfactants include monoalkyl (methyl, ethyl, etc.) ethers of monopentoses such as xylose, arabinose, ribose, xylulose and lyxose and monohexoses such as glucose, mannose, galactose and fructose. In the present invention, it is preferable that the above-mentioned sugar ester surfactant is a monoester/diester mixture containing monoesters and diesters, wherein fatty acid residue(s) having 6 to 18 carbon atoms have been attached to one (monoester) or two (diester) hydroxyl groups of a monosaccharide alkyl ether, while the content of polyesters (i.e., triesters and above) is not more than 1% by weight.

Examples of the sugars constituting the above-mentioned esters of the fatty acids having 6 to 18 carbon atoms with the sugars include monosaccharides such as xylose, arabinose, rubulose, ribose, glucose, mannose, galactose and fructose, disaccharides such as maltose, lactose and sucrose and oligosaccharides represented by $(C_8H_{14}O_7)_n$[n=3 to 6] such as raffinose and stachyose. Although the number of the ester bonds in these sugar esters in not particularly restricted, mono-, di- and triesters are preferable and monoesters are still preferable.

Particular examples of the fatty acids constituting the fatty acid residues of the above-mentioned sugar amides (4) represented by the formula (V) include the same ones as those cited as the fatty acids constituting the above-mentioned compound (3). Particular examples of the above-mentioned compound (4) include capric acid sugar amide, lauric acid sugar amide, myristic acid sugar amide, palmitic acid sugar amide, stearic acid sugar amide and oleic acid sugar amide. In particular, lauric acid sugar amide, myristic acid sugar amide and palmitic acid sugar amide are preferable therefor.

The content of the above-mentioned component (d) in the composition of the present invention preferably ranges from 1 to 30% by weight, still preferably from 3 to 10% by weight. When this content is smaller than 1% by weight, any improvement in the emulsifying power cannot be observed in some cases. On the other hand, it is not preferable that the content exceeds 30% by weight, since the stability of the solution is sometimes deteriorated in such a case.

The composition of the present invention may further contain, as the component (e), from 0.1 to 10% by weight, preferably from 0.5 to 7% by weight, of a linear or branched fatty acid salt having 5 to 23, preferably 8 to 16, carbon atoms to thereby further improve the foaming performance. Preferable examples of the fatty acids constituting the above-mentioned fatty acid salt include beef tallow fatty acids, coconut oil fatty acids and palm oil fatty acids. Among all, coconut oil fatty acids are preferable therefor. Examples of the salt constituting the above-mentioned fatty acid salt include alkali metal salts such as sodium and potassium salts, alkanolammonium salts such as monoethanolammonium ($HOCH_2CH_2NH_3^+$), diethanolammonium ($(HOCH_2CH_2)_2NH_2^+$) and triethanolammonium ($(HOCH_2CH_2)_3NH^+$) salts and ammonium salts. Among all, alkali metal salts such as sodium and potassium salts are preferable therefor.

The composition of the present invention may furthermore contain, as the component (f), from 1 to 30% by weight, preferably from 3 to 10% by weight, of one or more anionic surfactants selected from among a group consisting of alkyl ($C_8$–$C_{18}$) sulfates, polyoxyethylene (average number of moles added: 1 to 10) alkyl ($C_8$–$C_{18}$) ether sulfates, linear alkyl ($C_8$–$C_{18}$) benzenesulfonates, α-olefine ($C_8$–$C_{18}$) sulfonates, alkane ($C_8$–$C_{18}$) sulfonates, α-sulfo fatty acid ($C_8$–$C_{18}$) methyl ester salts, polyoxyethylene (average number of moles added: 1 to 10) alkyl ($C_8$–$C_{18}$) ether acetates, alkyl ($C_8$–$C_{18}$) glyceryl ether sulfates, α-sulfo fatty acid ($C_8$–$C_{18}$) salts and polyoxyethylene glycol (average number of moles added: 1–10) α-sulfo fatty acid ($C_8$–$C_{18}$) ester salts to thereby further improve the foaming performance.

Among the substances cited above as the component (f), preferable ones include polyoxyethylene (average number of moles added: 1 to 10) alkyl ($C_8$–$C_{18}$) ether sulfates, α-sulfo fatty acid ($C_8$–$C_{18}$) methyl enter salts, α-sulfo fatty acid ($C_8$–$C_{18}$) salts and polyoxyethylene glycol (average number of moles added: 1–10) α-sulfo fatty acid ($C_8$–$C_{18}$) ester salts. In particular, polyoxyethylene (average number of moles added: 1 to 10) alkyl ($C_8$–$C_{18}$) ether sulfates, α-sulfo fatty acid ($C_8$–$C_{18}$) salts and polyoxyethylene glycol (average number of moles added: 1–10) α-sulfo fatty acid ($C_8$–$C_{18}$) ester salts are preferable therefor.

Moreover, the composition of the present invention can optionally contain the following surfactants in order to improve the detergency and foaming power.

As the above-mentioned surfactants other than those cited above, nonionic surfactants and ampholytic ones are particularly preferable.

Examples of the above-mentioned nonionic surfactants include alkyl (number of carbon atoms: 8–18, linear or branched) glyceryl ethers and alkyl (number of carbon atoms: 8–18, linear or branched) glycosides. Among all, alkyl glyceryl ethers and alkylglycosides are preferable therefor.

The term "alkylglycosides" an used herein means those represented by the following formula (IX):

$$R_9(OR_{10})xGy \qquad \text{(IX)}$$

wherein $R_9$ represents a linear or branched alkyl, alkenyl or alkylphenyl group having 8 to 18 carbon atoms; $R_{10}$ represents an alkylene group having 2 to 4 carbon atoms; G represents a residue originating in a reducing sugar having 5 or 6 carbon atoms; x represents a number of 0 to 5 on average; and y represents a number of 1 to 10 on average.

From the viewpoint of solubility, foaming power and detergency, preferable examples of the alkyl, alkenyl or alkylphenyl group represented by $R_9$ are those having 10 to 14 carbon atoms. From the viewpoint of solubility, preferable examples of the alkylene group represented by $R_{10}$ are those having 2 carbon atoms. The structure of the residue G originating in a reducing sugar having 5 or 6 carbon atoms is determined depending on the monosaccharide or polysaccharide (i.e., disaccharide or one composed of more sugar molecules) employed.

Examples of the starting material for the residue G include monosaccharides such as glucose, galactose, xylose, mannose, lyxose, arabinose, fructose and mixtures thereof and polysaccharides such as maltose, xylobiose, isomaltose, cellobiose, gentiobiose, lactose, sucrose, nigerose, turanose, raffinose, gentianose, melezitose and mixtures thereof. Among these materials, preferable ones are glucose and fructose as monosaccharides and maltose and sucrose as polysaccharides, each from the viewpoints of availability and cost.

In the above formula (IX), x is from 0 to 5, preferably from 0 to 2, on average. The solubility in water and crystallinity of the alkyl glycoside can be controlled by regulating x. As the value of x increases, namely, the water solubility is elevated while the crystallinity is lowered.

In the above formula (IX), y is from 1 to 10, preferably from 1 to 1.4 and still preferably from 1.1 to 1.4, on average. When the average of y in the above-mentioned formula (IX) exceeds 1, i.e., the alkylglycoside carries a sugar chain of a polysaccharide an a hydrophilic group, it may involve an arbitrary mixture wherein the binding manner of the sugar chain is a 1–2, 1–3, 1–4 or 1–6 bond, an α- or β-pyranoside or furanoside bond or a mixture thereof. This value of y (i.e., the degree of sugar condensation of alkyl glycoside) can be determined by, for example, NMR.

The content of this alkylglycoside in the composition of the present invention ranges from 1 to 50% by weight, preferably from 1 to 20% by weight. When this content is smaller than 1% by weight, the detergency and foaming power cannot be sufficiently improved. On the other hand, it is not preferable that this content exceeds 50% by weight, since the production of the composition becomes difficult or, in the case of a liquid detergent, the stability of the solution is deteriorated in such a case.

Examples of the above-mentioned ampholytic surfactants include carbobetaine, sulfobetaine and imidazoliniumbetaine each having an alkyl or alkenyl group having 8 to 18 carbon atoms.

The composition of the present invention may furthermore contain other optional components, so long as the separation stability, detergency and foaming performance thereof are not deteriorated thereby. Examples of these optional components include solubilizers (for example, lower aliphatic alcohols such as ethyl alcohol, sodium salts and potassium salts of toluenesulfonic acid, xylenesulfonic acid, etc., urea), viscosity regulating agents (for example, mineral clay, polymers), water-insoluble abrasive materials (for example, calcite, sillimanite, calcium phosphate, zeolite, polyethylene, nylon, polystyrene), humectants (for example, glycerol, sorbitol), touch-improvers (for example, cationized cellulose), enzymes, perfumes, coloring matters, preservatives and mildew proofing agents.

The composition of the present invention may be produced by a conventional method. That is to say, the components (a) and (b), which are employed as the essential components, are blended with the above-mentioned components (c), (d), (e) and (f), other surfactants and other optional components, if necessary. Then water is added to the obtained mixture to thereby give an aqueous solution. [In usual, the concentration of the active components (i.e., components other than water) is adjusted to 5 to 80% by weight.] [In this process, the composition is substantially free from the above-mentioned component (z) or contains the component (a) in an amount of not more than 10% by weight of the sum of the contents of the components (a) and (b).]

The composition of the present invention is preferably in the form of a liquid. It is preferable that the pH value of the stock solution of the composition ranges from pH 4 to 10, still preferably from pH 5 to 8. Also, it is preferable that the composition of the present invention contains from 20 to 80% by weight of water.

The detergent composition according to the present invention is usable for various purposes including laundry detergents, dishwashing detergents, household detergents, hair shampoos and body cleansers. Among all, it is suitable for dishwashing detergents, hair shampoos and body cleansers, particularly suitable for dishwashing detergents.

To further illustrate the present invention in greater detail, and not by way of limitation, the following Examples and Comparative Examples will be given.

SYNTHESIS EXAMPLE 1

(Synthesis of amide ether carboxylate containing amide ether)

214.4 g (1 mol) of methyl laurate, 61.7 g (1.02 mol) of monoethanolamine and 15.3 g of a 30 wt. % solution of sodium methoxide in methanol were heated to 90° C. at 50 mmHg for 5 hours. Into the product thus obtained was introduced 88.2 g (2 mol) of ethylene oxide at 100 to 110° C. under a gauge pressure of 0 to 3.5 atm.

331 g of the reaction mixture was heated to 70 to 75° C. Then 174.8 g (1.5 mol) of sodium monochloroacetate (SMCA) and 65.2 g of solid sodium hydroxide were added thereto for 4 hours. The SXCA and sodium hydroxide were divided into 5 portions and added at the initiation of the reaction and 1, 2, 3 and 4 hours thereafter. After the final addition, the mixture was aged for 1 hour. Subsequently, the reaction temperature was elevated to 85° C. and 5.3 g of water was added to the mixture. After aging for additional 1 hour, 592 g of the reaction mixture was obtained. To the reaction mixture was added 500 g of water. Then the mixture was regulated to pH 2.8 by adding a 36% aqueous solution of hydrochloric acid at 90° C. After stirring for 1 hour, the mixture was allowed to stand to thereby separate into layers. Thus 545 g of an acid type product wag obtained. This acid type product was regulated to pH 7 with a 30% aqueous solution of sodium hydroxide and water was further added to thereby give a transparent solution. Thus the following amide ether derivative mixture was obtained. According to this method, the obtained product contained neither glycerol nor glyceryl ether represented by the above-mentioned formula (III).

Amide other derivative mixture content

Amide ether carboxylate (a) [a compound of the formula (I) wherein $R_1=C_{11}H_{23}$,

| | |
|---|---|
| n = 3, m = 0, A = H and M = Na] | 82 wt. %. |
| Amide ether (b) [a compound of the formula (II) wherein $R_1 = C_{11}H_{23}$, n = 3, m = 0 and B = H] | 14 wt. %. |
| Sum of (a) and (b) [(a):(b) = 85:15] | 96 wt. %. |
| Others (sodium chloride, glycolates) | 4 wt. %. |

Test method and evaluation criteria (1) Detergency test 0.1% by weight of Sudan III (a red coloring matter) was added to beef tallow an an indicator. The obtained mixture was applied in 2.5 g portions onto ceramic dishes (diameters 25 cm). Then the dishes were washed by rubbing with a sponge absorbing 3 g of a detergent and 27 g of water (hardness 3.5°DH) at 40° C. The detergency of the detergent was expressed in how many dishes could be washed until the beef tallow could not be completely eliminated any more.

(2) Foaming power test

To an aqueous solution of a detergent (detergent concentrations 1.0% by weight, water hardness: 3.5°DH, 40° C.), 1.0% by weight of a commercially available butter was added as a stain component. Then the foam thus formed was measured in the following manner. Namely, 40 ml of the above-mentioned detergent solution containing the butter was poured into a glass cylinder [5 cm (diameter)×12 cm (height)] and rotationally stirred for 10 minutes. Immediately after the termination of the stirring, the height of the foam was measured.

(3) Enzyme inhibition test

The inhibitory effect on acid phosphatase was measured as an indication of the protein denaturation by surfactants. The measurement was performed by the method of Imokawa at al. [Yukagaku, 25, (1), 24–30 (1976)]. According to this method, a detergent showing a lower enzyme inhibition ratio can be regarded as having the lower protein denaturation effect.

(4) Hand skin chapping test

An aqueous solution of a detergent (detergent concentration: 5% by weight, water hardness 3.5°DH, 40° C.) was prepared. 1 l of this aqueous solution of the detergent was introduced into a 2 lbeaker. Then a subject soaked the hands therein to the wrists for 20 minutes followed by thoroughly rinsing the hands with running water at 40° C. Ten subjects were employed and the above-mentioned procedure was repeated one a day for 4 days. On the fifth day, the conditions of the hands wore evaluated with the naked eye and expressed in the average score. In this test, it is preferable that the average score is smaller than 1.

No skin chapping: 0.

Slight skin chapping: 1.

Serious skin chapping: 2.

(5) Using feel test

An aqueous solution of a detergent (detergent concentrations 5% by weight, water hardness 3.5°DH, 40° C.) was prepared. 1 l of this aqueous solution of the detergent was introduced into a 2 l beaker and a ceramic crucible was soaked therein.

One hand of a panelist was soaked in the sample aqueous solution while another hand was soaked in hard water (3.5°DH) at the same time. Then the difference in the slipperiness on the surface of the crucible was evaluated by five skilled panelists. The result was expressed in the average score. In this test, it is preferable that the average score is smaller than 1.

No difference: 0.

Slightly slippery: 1.

Highly slippery: 2.

EXAMPLE 1

Detergent compositions as listed in the following Tables 1 to 9 were prepared and evaluated in detergency, foaming power, enzyme inhibition, hand skin chapping and feel at use. Tables 1 to 9 also give the results. The component (a)/component (b) as given in these Tables were those prepared by the same methods as the ones described in Synthetic Example 1. The component (a) substantially free from the component (b) was one from which the component (b) had been eliminated by the column separation method.

TABLE 1

(Content: expressed in wt. %)

| | | | | | Invention product | | | | | | | | |
|---|---|---|---|---|---|---|---|---|---|---|---|---|---|
| Component* | | | | | 1 | 2 | 3 | 4 | 5 | 6 | 7 | 8 | 9 |
| (a) | | | | | | | | | | | | | |
| $R_1$ | n | m | A | M | | | | | | | | | |
| $C_{11}H_{23}$ | 2 | 0 | H | Na | 10 | | | | | | 10 | | 25 |
| $C_{11}H_{23}$ | 3 | 0 | H | Na | | 10 | | | | | | 5 | |
| $C_{11}H_{23}$ | 4 | 0 | H | Mg | | | 10 | | | | | | |
| $C_{11}H_{23}$ | 2 | 1 | H | Ca | | | | 10 | | | | | |
| $C_{13}H_{27}$ | 4 | 0 | $CH_3$ | Na | | | | | 10 | | | | |
| $C_{13}H_{27}$ | 5 | 0 | H | $NH_4$ | | | | | | 10 | | | |
| (b) | | | | | | | | | | | | | |
| $R_2$ | n | m | B | — | | | | | | | | | |
| $C_{11}H_{23}$ | 1 | 0 | H | — | 10 | | 5 | | | | 10 | | 2 |
| $C_{11}H_{23}$ | 2 | 0 | H | — | | 10 | | 5 | | | | 20 | |
| $C_{11}H_{23}$ | 3 | 0 | H | — | | | | | 10 | | | | |
| $C_{13}H_{27}$ | 3 | 0 | H | — | | | | | | 10 | | | |
| magnesium chloride | | | | | 0.5 | | | 0.5 | | 1 | | | |
| magnesium sulfate | | | | | | 0.5 | | | 0.5 | | | 1 | |
| calcium chloride | | | | | | | 0.5 | | | 0.5 | | | 1 |
| (z) | | | | | | | | | | | | | |
| glycerol or glyceryl ether represented by formula (III) | | | | | | | | | | | | | |
| linear $C_{12}$ fatty acid Na | | | | | | 1 | 1 | 1 | | | 0.5 | 2 | |
| $C_{12}H_{25}SO_3Na$ | | | | | | | | | | | | | 5 |
| $C_{12}H_{25}O(CH_2CH_2O)_{2.5}SO_3Na$ | | | | | | | | | | | | | |
| α-sulfo fatty acid Na salt ($C_{14}$) | | | | | | | | | | | | | |
| polyoxyethylene glycol (EO4.5) α-sulfolauric acid monoester Na salt | | | | | | | | | | | | | |
| polyoxyethylene (EO4) lauryl ether acetic acid salt | | | | | | | | | | | | | |
| ethanol | | | | | 5 | 5 | 5 | 5 | 5 | 5 | 5 | 5 | 5 |
| Na p-toluenesulfonate | | | | | 3 | 3 | 3 | 3 | 3 | 3 | 3 | 3 | 3 |
| water | | | | | the balance | ← | ← | ← | ← | ← | ← | ← | ← |
| pH (stock solution) | | | | | 7 | 6 | 7 | 6 | 7 | 7 | 7 | 6 | 7 |
| Evaluation: | | | | | | | | | | | | | |
| detergency (No. of dishes) | | | | | 16 | 14 | 14 | 16 | 14 | 15 | 16 | 16 | 13 |
| foaming power (mm) | | | | | 86 | 100 | 101 | 100 | 94 | 95 | 99 | 105 | 100 |
| enzyme inhibition (%) | | | | | 17 | 15 | 19 | 20 | 20 | 23 | 18 | 21 | 21 |
| hand skin chapping | | | | | 0.5 | 0.5 | 0.5 | 1 | 0.5 | 1 | 0.5 | 1 | 1 |
| feel at use | | | | | 0.4 | 0.5 | 0.3 | 0.4 | 0.5 | 0.4 | 0.5 | 0.4 | 0.4 |
| a/b | | | | | 1 | 1 | 2 | 2 | 1 | 1 | 1 | 0.25 | 12.5 |
| X/Y | | | | | 0.19 | 0.14 | 0.29 | 0.32 | 0.21 | 0.24 | 0.36 | 0.39 | 0.10 |

*:component (a): compound of the formula (I) as defined below.
component (b): compound of the formula (II) as defined below.

TABLE 2

(Content: expressed in wt. %)

| Component* | | | | | Invention product | | | | | | | | |
|---|---|---|---|---|---|---|---|---|---|---|---|---|---|
| | | | | | 10 | 11 | 12 | 13 | 14 | 15 | 16 | 17 | 18 |
| (a) | | | | | | | | | | | | | |
| $R_1$ | n | m | A | M | | | | | | | | | |
| $C_{11}H_{23}$ | 2 | 0 | H | Na | | 20 | | | | 5 | 5 | | 10 |
| $C_{11}H_{23}$ | 3 | 0 | H | Na | 10 | | | | 10 | | | | |
| $C_{11}H_{23}$ | 4 | 0 | H | Mg | | | 20 | | | | | 10 | |
| $C_{11}H_{23}$ | 2 | 1 | H | Ca | | | | 20 | | | | | |
| $C_{13}H_{27}$ | 4 | 0 | $CH_3$ | Na | | | | | | | 5 | | |
| $C_{13}H_{27}$ | 5 | 0 | H | $NH_4$ | | | | | | | | | |
| (b) | | | | | | | | | | | | | |
| $R_2$ | n | m | B | — | | | | | | | | | |
| $C_{11}H_{23}$ | 1 | 0 | H | — | | 10 | | 10 | | | | | |
| $C_{11}H_{23}$ | 2 | 0 | H | — | 10 | | 10 | | 15 | | | | 5 |
| $C_{11}H_{23}$ | 3 | 0 | H | — | | | | | | 5 | | 5 | |
| $C_{13}H_{27}$ | 3 | 0 | H | — | | | | | | | 10 | | |
| magnesium chloride | | | | | 2 | | | | 0.5 | 0.5 | 0.5 | 0.5 | |
| magnesium sulfate | | | | | | 3 | 0.1 | | | | | | 0.5 |
| calcium chloride | | | | | | | | 0.1 | | | | | |
| (z) | | | | | | | | | | | | | |
| glycerol or glyceryl ether represented by formula (III) | | | | | | | | | | | | | |
| linear $C_{12}$ fatty acid Na | | | | | | | | | | | | | |
| $C_{12}H_{25}SO_3Na$ | | | | | | | | | | 5 | 2 | | |
| $C_{12}H_{25}O(CH_2CH_2O)_{2.5}SO_3Na$ | | | | | | | | | 2 | 5 | | | |
| α-sulfo fatty acid Na salt ($C_{14}$) | | | | | | | | | | | | 8 | |
| polyoxyethylene glycol (EO4.5) α-sulfolauric acid monoester Na salt | | | | | | | | | | | | | 8 |
| polyoxyethylene (EO4) lauryl ether acetic acid salt | | | | | | | | | | | | | |
| ethanol | | | | | 5 | 5 | 5 | 5 | 5 | 5 | 5 | 5 | 5 |
| Na p-toluenesulfonate | | | | | 3 | 3 | 3 | 3 | 3 | 3 | 3 | 3 | 3 |
| water | | | | | the balance | ← | ← | ← | ← | ← | ← | ← | ← |
| pH (stock solution) | | | | | 7 | 7 | 6 | 7 | 6 | 7 | 7 | 7 | 7 |
| Evaluation: | | | | | | | | | | | | | |
| detergency (No. of dishes) | | | | | 15 | 15 | 16 | 15 | 16 | 14 | 14 | 15 | 15 |
| foaming power (mm) | | | | | 88 | 90 | 92 | 93 | 97 | 98 | 102 | 101 | 100 |
| enzyme inhibition (%) | | | | | 23 | 19 | 20 | 19 | 26 | 28 | 24 | 27 | 24 |
| hand skin chapping | | | | | 1 | 0.5 | 1 | 1 | 1 | 1 | 1 | 1 | 1 |
| feel at use | | | | | 0.5 | 0.5 | 0.5 | 0.6 | 0.8 | 0.9 | 0.7 | 0.9 | 0.8 |
| a/b | | | | | 1 | 2 | 2 | 2 | 0.67 | 1 | 1 | 2 | 2 |
| X/Y | | | | | 0.86 | 0.46 | 0.04 | 0.04 | 0.18 | 0.12 | 0.17 | 0.16 | 0.10 |

*:component (a): compound of the formula (I) as defined below.
component (b): compound of the formula (II) as defined below.

TABLE 3

(Content: expressed in wt. %)

| Component* | | | | | Invention product | | | | | | | |
|---|---|---|---|---|---|---|---|---|---|---|---|---|
| | | | | | 19 | 20 | 21 | 22 | 23 | 24 | 25 | 26 |
| (a) | | | | | | | | | | | | |
| $R_1$ | n | m | A | M | | | | | | | | |
| $C_{11}H_{23}$ | 2 | 0 | H | Na | | | | | | 10 | | |
| $C_{11}H_{23}$ | 3 | 0 | H | Na | 10 | | 8 | | 5 | | | 8 |
| $C_{11}H_{23}$ | 4 | 0 | H | Mg | | | | 8 | | | 25 | |
| $C_{11}H_{23}$ | 2 | 1 | H | Ca | | | | | | | | |
| $C_{13}H_{27}$ | 4 | 0 | $CH_3$ | Na | | 10 | | | | | | |
| $C_{13}H_{27}$ | 5 | 0 | H | $NH_4$ | | | | | | | | |

TABLE 3-continued (Content: expressed in wt. %)

| Component* | | | | | Invention product 19 | 20 | 21 | 22 | 23 | 24 | 25 | 26 |
|---|---|---|---|---|---|---|---|---|---|---|---|---|
| (b) | | | | | | | | | | | | |
| $R_2$ | n | m | B | — | | | | | | | | |
| $C_{11}H_{23}$ | 1 | 0 | H | — | 5 | | | | 10 | 10 | | |
| $C_{11}H_{23}$ | 2 | 0 | H | — | | | 8 | | | | 5 | 8 |
| $C_{11}H_{23}$ | 3 | 0 | H | — | | | | 8 | | | | |
| $C_{13}H_{27}$ | 3 | 0 | H | — | | 5 | | | | | | |
| magnesium chloride | | | | | | | | | 1 | | | 1 |
| magnesium sulfate | | | | | | 1 | 2 | | | 0.5 | 1 | |
| calcium chloride | | | | | 0.5 | | | 0.2 | | | | |
| (z) | | | | | | | | | | | | |
| glycerol or glyceryl ether represented by formula (III) | | | | | | | | | | 0.4 | 0.9 | 0.3 |
| linear $C_{12}$ fatty acid Na | | | | | | 1 | | 1 | | | 3 | 1 |
| $C_{12}H_{25}SO_3Na$ | | | | | | | | | | | | |
| $C_{12}H_{25}O(CH_2CH_2O)_{2.5}SO_3Na$ | | | | | | | 4 | 4 | 4 | | | 4 |
| α-sulfo fatty acid Na salt ($C_{14}$) | | | | | | 4 | 4 | | | | | |
| polyoxyethylene glycol (EO4.5) α-sulfolauric acid monoester Na salt | | | | | | 4 | | 4 | | | | 4 |
| polyoxyethylene (EO4) lauryl ether acetic acid salt | | | | | 8 | | | | 4 | | | |
| ethanol | | | | | 5 | 5 | 5 | 5 | 5 | 5 | 5 | 5 |
| Na p-toluenesulfonate | | | | | 3 | 3 | 3 | 3 | 3 | 3 | 3 | 3 |
| water | | | | | the balance | ← | ← | ← | ← | ← | ← | ← |
| pH (stock solution) | | | | | 7 | 7 | 6 | 7 | 6 | 7 | 7 | 7 |
| Evaluation: | | | | | | | | | | | | |
| detergency (No. of dishes) | | | | | 14 | 15 | 16 | 15 | 15 | 14 | 13 | 15 |
| foaming power (mm) | | | | | 102 | 101 | 99 | 102 | 101 | 92 | 91 | 91 |
| enzyme inhibition (%) | | | | | 24 | 25 | 26 | 26 | 24 | 18 | 19 | 26 |
| hand skin chapping | | | | | 1 | 1 | 1 | 1 | 1 | 0.5 | 0.5 | 1 |
| feel at use | | | | | 0.5 | 0.8 | 0.7 | 0.8 | 0.6 | 0.4 | 0.5 | 0.8 |
| a/b | | | | | 2 | 2 | 1 | 1 | 0.5 | 1 | 5 | 1 |
| X/Y | | | | | 0.11 | 0.19 | 0.41 | 0.06 | 0.34 | 0.15 | 0.20 | 0.25 |

*:component (a): compound of the formula (I) as defined below.
component (b): compound of the formula (II) as defined below.

TABLE 4

(Content: expressed in wt. %)

| Component* | | | | | Invention product 27 | 28 | 29 | 30 | 31 | 32 | 33 | 34 | 35 | 36 |
|---|---|---|---|---|---|---|---|---|---|---|---|---|---|---|
| (a) | | | | | | | | | | | | | | |
| $R_2$ | n | m | A | M | | | | | | | | | | |
| $C_{11}H_{23}$ | 3 | 0 | H | Na | | | | 5 | | 10 | | | | 10 |
| $C_{11}H_{23}$ | 4 | 0 | H | Mg | 8 | | 5 | | 15 | | | | 10 | |
| $C_{11}H_{23}$ | 2 | 1 | H | Ca | | | | | | | 10 | | | |
| $C_{13}H_{27}$ | 4 | 0 | H | Na | | 8 | | | | | | | | |
| $C_{13}H_{27}$ | 5 | 0 | $CH_3$ | $NH_4$ | | | | | | | | 10 | | |
| (b) | | | | | | | | | | | | | | |
| $R_2$ | n | m | B | — | | | | | | | | | | |
| $C_{11}H_{23}$ | 3 | 0 | H | — | | 5 | | 5 | | 8 | | 8 | | 5 |
| $C_{11}H_{23}$ | 4 | 0 | H | — | 5 | | 8 | | | | | | 5 | |
| $C_{13}H_{27}$ | 3 | 0 | H | — | | | | | 3 | | 8 | | | |
| (z) glycerol or glyceryl ether represented by formula (III) | | | | | | | | | 1 | | | | 0.2 | |
| magnesium chloride | | | | | | | | | | | | | 1 | 1 |
| magnesium sulfate | | | | | 1 | | 1 | 1 | | 1 | | 1 | | |
| calcium chloride | | | | | | 1 | | | 1 | | 1 | | | |
| POE ($C_{12}EO8$)*1 | | | | | 5 | | | 15 | | | | | | |
| lauric acid diethanol amide | | | | | | | | | | | | | 5 | |
| sucrose lauric acid ester*2 | | | | | | 5 | | | | | | | | |

TABLE 4-continued (Content: expressed in wt. %)

| Component* | Invention product | | | | | | | | | |
|---|---|---|---|---|---|---|---|---|---|---|
| | 27 | 28 | 29 | 30 | 31 | 32 | 33 | 34 | 35 | 36 |
| sugar ester*3 | | | | | | | | | | 5 |
| sugar amide*4 | | | 5 | | 5 | | | | | |
| $C_{12}$ amine oxide | | | | | | 5 | | 5 | | |
| $C_{14}$ amidepropyl amine oxide | | | | | | | 5 | | | |
| alklyglycoside represented by formula (VIII) | | | | | | | | | | |
| $R_9$ x y | | | | | | | | | | |
| $C_{12}H_{25}$ 0 1.4 | | | | | | | | | | |
| $C_{12}H_{25}$ 0 2.0 | | | | | | | | | | |
| $C_{10}H_{21}$ 0 1.2 | | | | | | | | | | |
| linear $C_{12}$ fatty acid Na | 1 | 1 | 1 | | | 1 | 1 | 1 | | |
| ethanol | 5 | 5 | 5 | 5 | 5 | 5 | 5 | 5 | 5 | 5 |
| Na p-toluenesulfonate | 3 | 3 | 3 | 3 | 3 | 3 | 3 | 3 | 3 | 3 |
| water | the balance | ← | ← | ← | ← | ← | ← | ← | ← | ← |
| pH (stock solution) | 7 | 7 | 7 | 7 | 7 | 7 | 7 | 7 | 7 | 7 |
| Evaluation: | | | | | | | | | | |
| detergency (No. of dishes) | 19 | 18 | 19 | 17 | 18 | 19 | 19 | 18 | 18 | 19 |
| foaming power (mm) | 101 | 105 | 105 | 100 | 93 | 100 | 101 | 101 | 102 | 105 |
| enzyme inhibition (%) | 23 | 20 | 22 | 19 | 18 | 18 | 17 | 18 | 19 | 19 |
| hand skin chapping | 0.5 | 0.5 | 0.5 | 0.5 | 0.5 | 0.5 | 0.5 | 0.5 | 0.4 | 0.5 |
| feel at use | 0.3 | 0.4 | 0.5 | 0.5 | 0.4 | 0.5 | 0.4 | 0.4 | 0.4 | 0.5 |

*:component (a): compound of the formula (I) as defined below.
component (b): compound of the formula (II) as defined below.
*1: polyoxyethylene (average addition mole number 8 to 15) alkyl ($C_{12}$) ether
*2: mono/diester mixture
*3: glucose octanic acid monoester
*4: sugar amide represented by formula (VII) wherein $R_6 = C_{12}$ linear alkyl and $R_7$ = H.
*5: sodium p-toluenesulfonate

TABLE 5

(Content: expressed in wt. %)

| Component* | Invention product | | | | | | | |
|---|---|---|---|---|---|---|---|---|
| | 37 | 38 | 39 | 40 | 41 | 42 | 43 | 44 |
| (a) | | | | | | | | |
| $R_2$ n m A M | | | | | | | | |
| $C_{11}H_{23}$ 3 0 H Na | | 8 | | | | | | 8 |
| $C_{11}H_{23}$ 4 0 H Mg | 8 | | | | | 10 | | |
| $C_{11}H_{23}$ 2 1 H Ca | | | 5 | | | | 10 | |
| $C_{13}H_{27}$ 4 0 H Na | | | | 10 | | | | |
| $C_{13}H_{27}$ 5 0 $CH_3$ $NH_4$ | | | | | 8 | | | |
| (b) | | | | | | | | |
| $R_2$ n m B — | | | | | | | | |
| $C_{11}H_{23}$ 3 0 H — | | 5 | | | | | | 5 |
| $C_{11}H_{23}$ 4 0 H — | 5 | | | | | 5 | | |
| $C_{13}H_{27}$ 3 0 H — | | | 10 | 5 | 3 | | 5 | |
| (z) glycerol or glyceryl ether represented by formula (III) | | | | | | | | |
| magnesium chloride | | 1 | | | | 1 | | |
| magnesium sulfate | 1 | | | 1 | 1 | | 1 | 1 |
| calcium chloride | | | 1 | | | | | |
| POE ($C_{12}EO8$)*1 | | | 2 | | | | | |
| lauric acid diethanol amide | 2 | | | | | | | |
| $C_{12}H_{25}SO_3Na$ | | 2 | | | | | | 2 |
| $C_{12}H_{25}O(CH_2CH_2O)_{2.5}SO_3Na$ | | | | 1 | | | | |
| α-sulfo fatty acid Na salt ($C_{14}$) | | | | | 2 | | | |
| $C_{12}$ amine oxide | | | | | | 2 | | 1 |
| $C_{14}$ amidepropyl amine oxide | | | | | | | 2 | |
| alkylglycoside represented by formula (VIII) | | | | | | | | |

TABLE 5-continued (Content: expressed in wt. %)

| Component* | | | Invention product | | | | | | | |
|---|---|---|---|---|---|---|---|---|---|---|
| | | | 37 | 38 | 39 | 40 | 41 | 42 | 43 | 44 |
| $R_9$ | x | y | | | | | | | | |
| $C_{12}H_{25}$ | 0 | 1.4 | 3 | | | 3 | 3 | 3 | 3 | 2 |
| $C_{12}H_{25}$ | 0 | 2.0 | | 3 | | | | | | |
| $C_{10}H_{21}$ | 0 | 1.2 | | | 3 | | | | | |
| linear $C_{12}$ fatty acid Na | | | 1 | | | 1 | 1 | | | 1 |
| ethanol | | | 5 | 5 | 5 | 5 | 5 | 5 | 5 | 5 |
| Na p-toluenesulfonate | | | 3 | 3 | 3 | 3 | 3 | 3 | 3 | 3 |
| water | | | the balance | ← | ← | ← | ← | ← | ← | ← |
| pH (stock solution) | | | 7 | 7 | 7 | 7 | 7 | 7 | 7 | 7 |
| Evaluation: | | | | | | | | | | |
| detergency (No. of dishes) | | | 20 | 19 | 19 | 19 | 19 | 20 | 19 | 20 |
| foaming power (mm) | | | 105 | 102 | 100 | 101 | 105 | 100 | 102 | 108 |
| enzyme inhibition (%) | | | 20 | 15 | 18 | 25 | 40 | 25 | 30 | 25 |
| hand skin chapping | | | 0.5 | 0.4 | 0.5 | 0.5 | 0.5 | 0.4 | 0.5 | 0.5 |
| feel at use | | | 0.5 | 0.4 | 0.5 | 0.5 | 0.5 | 0.4 | 0.4 | 0.5 |

*:component (a): compound of the formula (I) as defined below.
component (b): compound of the formula (II) as defined below.
*1: polyoxyethylene (average addition mole number 8 to 15) alkyl ($C_{12}$) ether
*2: mono/diester mixture
*3: glucose octanic acid monoester
*4: sugar amide represented by formula (VII) wherein $R_6$ = $C_{12}$ linear alkyl and $R_7$ = H
*5: sodium p-toluenesulfonate

TABLE 6

(Content: expressed in wt. %)

| Component* | | | | | Comparative product | | | | | | |
|---|---|---|---|---|---|---|---|---|---|---|---|
| | | | | | 1 | 2 | 3 | 4 | 5 | 6 | 7 |
| (a) | | | | | | | | | | | |
| $R_1$ | n | m | A | M | | | | | | | |
| $C_{11}H_{23}$ | 2 | 0 | H | Na | | | | | 15 | | |
| $C_{11}H_{23}$ | 3 | 0 | H | Na | | | | | | 15 | |
| $C_{11}H_{23}$ | 4 | 0 | H | Mg | | | | | | | |
| $C_{11}H_{23}$ | 2 | 1 | H | Ca | | | | | | | |
| $C_{13}H_{27}$ | 4 | 0 | $CH_3$ | Na | | | | | | | |
| $C_{13}H_{27}$ | 5 | 0 | H | $NH_4$ | | | | | | | 15 |
| (b) | | | | | | | | | | | |
| $R_2$ | n | m | B | — | | | | | | | |
| $C_{11}H_{23}$ | 1 | 0 | H | — | 10 | | 10 | | | | |
| $C_{11}H_{23}$ | 2 | 0 | H | — | | 10 | | 10 | | 10 | |
| $C_{11}H_{23}$ | 3 | 0 | H | — | | | | | | | |
| $C_{13}H_{27}$ | 3 | 0 | H | — | | | | | | | |
| magnesium chloride | | | | | | | 1 | | | | |
| magnesium sulfate | | | | | | | | 1 | | | |
| calcium chloride | | | | | | | | | | | |
| (z) | | | | | | | | | | | |
| glycerol or glyceryl ether represented by formula (III) | | | | | | | | | | | |
| linear $C_{12}$ fatty acid Na | | | | | | 1 | | 1 | | 1 | 1 |
| $C_{12}H_{25}SO_3Na$ | | | | | | | 5 | | | | |
| $C_{12}H_{25}O(CH_2CH_2O)_{2.5}SO_3Na$ | | | | | | 5 | | | | | 2 |
| α-sulfo fatty acid Na salt ($C_{14}$) | | | | | | | | | | | |
| polyoxyethylene glycol (EO4.5) α-sulfolauric acid monoester Na salt | | | | | | | | | | | |
| polyoxyethylene (EO4) lauryl ether acetic acid salt | | | | | | | | | | | |
| ethanol | | | | | 5 | 5 | 5 | 5 | 5 | 5 | 5 |
| Na p-toluenesulfonate | | | | | 3 | 3 | 3 | 3 | 3 | 3 | 3 |
| water | | | | | the balance | ← | ← | ← | ← | ← | ← |
| pH (stock solution) | | | | | 7 | 7 | 7 | 7 | 7 | 7 | 7 |

TABLE 6-continued (Content: expressed in wt. %)

| Component* | Comparative product 1 | 2 | 3 | 4 | 5 | 6 | 7 |
|---|---|---|---|---|---|---|---|
| Evaluation: | | | | | | | |
| detergency (No. of dishes) | 10 | 14 | 14 | 10 | 15 | 13 | 14 |
| foaming power (mm) | 28 | 62 | 30 | 60 | 28 | 83 | 84 |
| enzyme inhibition (%) | 17 | 27 | 25 | 19 | 19 | 19 | 25 |
| hand skin chapping | 1 | 1 | 1 | 1 | 0.5 | 0.5 | 1 |
| feel at use | 1.9 | 1.4 | 1.2 | 1.9 | 2.0 | 1.6 | 1.7 |
| a/b | 0 | 0 | 0 | 0 | — | 1.5 | — |
| X/Y | — | 0 | 0.57 | 1.85 | 0 | 0 | 0 |

*:component (a): compound of the formula (I) as defined below.
component (b): compound of the formula (II) as defined below.

TABLE 7

(Content: expressed in wt. %)

| Component* | Comparative product 8 | 9 | 10 | 11 | 12 | 13 | 14 |
|---|---|---|---|---|---|---|---|
| (a) | | | | | | | |
| $R_1$ n m A M | | | | | | | |
| $C_{11}H_{23}$ 2 0 H Na | | | | 10 | | 5 | |
| $C_{11}H_{23}$ 3 0 H Na | 15 | | | | | | |
| $C_{11}H_{23}$ 4 0 H Mg | | | | | 10 | | 8 |
| $C_{11}H_{23}$ 2 1 H Ca | | | | | | | |
| $C_{13}H_{27}$ 4 0 $CH_3$ Na | | | | | | 5 | |
| $C_{13}H_{27}$ 5 0 H $NH_4$ | | | | | | | |
| (b) | | | | | | | |
| $R_2$ n m B — | | | | | | | |
| $C_{11}H_{23}$ 1 0 H — | | | | 10 | | | |
| $C_{11}H_{23}$ 2 0 H — | | | | | 8 | | |
| $C_{11}H_{23}$ 3 0 H — | 10 | | | | | | 8 |
| $C_{13}H_{27}$ 3 0 H — | | | | | | 10 | |
| magnesium chloride | | | | | | 0.5 | |
| magnesium sulfate | | | | 0.5 | | | |
| calcium chloride | | | | | 1 | | 0.2 |
| (z) | | | | | | | |
| glycerol or glyceryl ether represented by formula (III) | | | | 2.4 | 2.1 | 3 | 3.2 |
| linear $C_{12}$ fatty acid Na | | | | | | | 1 |
| $C_{12}H_{25}SO_3Na$ | | 10 | 20 | | | 2 | |
| $C_{12}H_{25}O(CH_2CH_2O)_{2.5}SO_3Na$ | 5 | 10 | | | | | 4 |
| α-sulfo fatty acid Na salt ($C_{14}$) | | | | | | | |
| polyoxyethylene glycol (EO4.5) α-sulfolauric acid monoester Na salt | | | | | | | 4 |
| polyoxyethylene (EO4) lauryl ether acetic acid salt | | | | | | | |
| ethanol | 5 | 5 | 5 | 5 | 5 | 5 | 5 |
| Na p-toluenesulfonate | 3 | 3 | 3 | 3 | 3 | 3 | 3 |
| water | the balance | ← | ← | ← | ← | ← | ← |
| pH (stock solution) | 7 | 7 | 7 | 7 | 7 | 7 | 6 |
| Evaluation: | | | | | | | |
| detergency (No. of dishes) | 14 | 12 | 11 | 12 | 13 | 10 | 14 |
| foaming power (mm) | 90 | 95 | 88 | 32 | 38 | 30 | 26 |
| enzyme inhibition (%) | 28 | 75 | 80 | 19 | 17 | 23 | 24 |
| hand skin chapping | 1 | 2 | 2 | 0.5 | 0.5 | 1 | 1 |
| feel at use | 1.6 | 1.9 | 1.8 | 0.5 | 0.7 | 0.9 | 0.9 |
| a/b | 1.5 | — | — | 1 | 1.25 | 1 | 1 |
| X/Y | 0 | 0 | 0 | 0.15 | 0.80 | 0.17 | 0.06 |

*:component (a): compound of the formula (I) as defined below.
component (b): compound of the formula (II) as defined below.

TABLE 8

| Component* | | | | | (Content: expressed in wt. %) Comparative product 15 | 16 | 17 | 18 |
|---|---|---|---|---|---|---|---|---|
| (a) | | | | | | | | |
| $R_2$ | n | m | A | M | | | | |
| $C_{11}H_{23}$ | 3 | 0 | H | Na | 15 | | | |
| $C_{11}H_{23}$ | 4 | 0 | H | Mg | | 15 | 8 | |
| $C_{11}H_{23}$ | 2 | 1 | H | Ca | | | | 10 |
| $C_{13}H_{27}$ | 4 | 0 | H | Na | | | | |
| $C_{13}H_{27}$ | 5 | 0 | $CH_3$ | $NH_4$ | | | | |
| (b) | | | | | | | | |
| $R_2$ | n | m | B | — | | | | |
| $C_{11}H_{23}$ | 3 | 0 | H | — | | | | |
| $C_{11}H_{23}$ | 4 | 0 | H | — | | | 5 | |
| $C_{13}H_{27}$ | 3 | 0 | H | — | | 3 | | 8 |
| (z) glycerol or glyceryl ether represented by formula (III) | | | | | | 3 | 3.5 | 3 |
| magnesium chloride | | | | | | | | |
| magnesium sulfate | | | | | | | | |
| calcium chloride | | | | | | 1 | 1 | |
| POE ($C_{12}$EO8)*1 | | | | | | | | |
| lauric acid diethanol amide | | | | | | | | |
| sucrose lauric acid ester*2 | | | | | | | 5 | |
| sugar ester*3 | | | | | | | | |
| sugar amide*4 | | | | | | 5 | | |
| $C_{12}$ amine oxide | | | | | 8 | | | |
| $C_{14}$ amidepropyl amine oxide | | | | | | | | 5 |
| alkyglycoside represented by formula (VIII) | | | | | | | | |
| $R_9$ | x | y | | | | | | |
| $C_{12}H_{25}$ | 0 | 1.4 | | | | | | |
| $C_{12}H_{25}$ | 0 | 2.0 | | | | | | |
| $C_{10}H_{21}$ | 0 | 1.2 | | | | | | |
| linear $C_{12}$ fatty acid Na | | | | | 1 | | 1 | 1 |
| ethanol | | | | | 5 | 5 | 5 | 5 |
| Na p-toluenesulfonate | | | | | 3 | 3 | 3 | 3 |
| water | | | | | the balance | ← | ← | ← |
| pH (stock solution) | | | | | 7 | 7 | 7 | 7 |
| Evaluation: | | | | | | | | |
| detergency (No. of dishes) | | | | | 10 | 11 | 10 | 9 |
| foaming power (mm) | | | | | 60 | 55 | 70 | 50 |
| enzyme inhibition (%) | | | | | 21 | 40 | 80 | 50 |
| hand skin chapping | | | | | 0.5 | 1.0 | 2.0 | 2.0 |
| feel at use | | | | | 2.0 | 0.9 | 2.0 | 1.5 |

*:component (a): compound of the formula (I) as defined below.
component (b): compound of the formula (II) as defined below.
*1:polyoxyethylene (average addition mole number 8 to 15) alkyl ($C_{12}$) ether
*2:mono/diester mixture
*3:glucose octanic acid monoester
*4:sugar amide represented by formula (VII) wherein $R_6$ = $C_{12}$ linear alkyl and $R_7$ = H.
*5:sodium p-toluenesulfonate

TABLE 9

| Component* | | | | | (Content: expressed in wt. %) Comparative product 19 | 20 | 21 | 22 |
|---|---|---|---|---|---|---|---|---|
| (a) | | | | | | | | |
| $R_2$ | n | m | A | M | | | | |
| $C_{11}H_{23}$ | 3 | 0 | H | Na | | | 8 | |
| $C_{11}H_{23}$ | 4 | 0 | H | Mg | 8 | | | |
| $C_{11}H_{23}$ | 2 | 1 | H | Ca | | 10 | | |

TABLE 9-continued

| Component* | | | | | (Content: expressed in wt. %) Comparative product 19 | 20 | 21 | 22 |
|---|---|---|---|---|---|---|---|---|
| $C_{13}H_{27}$ | 4 | 0 | H | Na | | | | |
| $C_{13}H_{27}$ | 5 | 0 | $CH_3$ | $NH_4$ | | | | 8 |
| (b) | | | | | | | | |
| $R_2$ | n | m | B | — | | | | |
| $C_{11}H_{23}$ | 3 | 0 | H | — | | | 5 | |
| $C_{11}H_{23}$ | 4 | 0 | H | — | 5 | | | |
| $C_{13}H_{27}$ | 3 | 0 | H | — | | 5 | | 3 |
| (z) glycerol or glyceryl ether represented by formula (III) | | | | | 3 | 3.5 | 3.2 | |
| magnesium chloride | | | | | | | | |
| magnesium sulfate | | | | | 1 | 1 | | |
| calcium chloride | | | | | | | | |
| POE ($C_{12}$EO8)*1 | | | | | | | | |
| lauric acid diethanol amide | | | | | 2 | | | |
| $C_{12}H_{25}SO_3Na$ | | | | | | | 2 | |
| $C_{12}H_{25}O(CH_2CH_2O)_{2.5}SO_3Na$ | | | | | | | | |
| α-sulfo fatty acid Na salt ($C_{14}$) | | | | | | | | 2 |
| $C_{12}$ amine oxide | | | | | | | 1 | |
| $C_{14}$ amidepropyl amine oxide | | | | | | 2 | | |
| alklyglycoside represented by formula (VIII) | | | | | | | | |
| $R_9$ | x | y | | | | | | |
| $C_{12}H_{25}$ | 0 | 1.4 | | | 3 | 3 | 2 | 3 |
| $C_{12}H_{25}$ | 0 | 2.0 | | | | | | |
| $C_{10}H_{21}$ | 0 | 1.2 | | | | | | |
| linear $C_{12}$ fatty acid Na | | | | | 1 | | 1 | 1 |
| ethanol | | | | | 5 | 5 | 5 | 5 |
| Na p-toluenesulfonate | | | | | 3 | 3 | 3 | 3 |
| water | | | | | the balance | ← | ← | ← |
| pH (stock solution) | | | | | 7 | 7 | 7 | 7 |
| Evaluation: | | | | | | | | |
| detergency (No. of dishes) | | | | | 10 | 9 | 11 | 11 |
| foaming power (mm) | | | | | 70 | 65 | 81 | 60 |
| enzyme inhibition (%) | | | | | 40 | 60 | 80 | 50 |
| hand skin chapping | | | | | 1.5 | 1.5 | 1.5 | 2 |
| feel at use | | | | | 1.5 | 1.8 | 1.5 | 1.9 |

*:component (a): compound of the formula (I) as defined below.
component (b): compound of the formula (II) as defined below.
*1:polyoxyethylene (average addition mole number 8 to 15) alkyl ($C_{12}$) ether
*2:mono/diester mixture
*3:glucose octanic acid monoester
*4:sugar amide represented by formula (VII) wherein $R_6$ = $C_{12}$ linear alkyl and $R_7$ = H
*5:sodium p-toluenesulfonate The results given in the above Tables 1 to 9 indicate that the detergent compositions of the present invention, namely, the invention products 1 to 23, which contain the above-mentioned components (a) and (b) and the divalent metal salt but no component (z) as described above, and the invention products 24 to 26, which contain the above-mentioned components (a) and (b) and the divalent metal salt and the component (z) in an amount of not more than 10% by weight of the sum of the contents of the components (a) and (b), are excellent in detergency, foaming power, enzyme inhibition, hand skin chapping score and feel in use. It is also indicated that the detergent compositions of the present invention (i.e., the invention products 1 to 26) are superior to the other detergent compositions (i.e., the comparative products 1 to 14) in particular in foaming power and feel in use.

The detergent composition of the present invention has a sufficient detergency and foaming power even in the presence of a large amount of oily stains, gives no slippery feeling and little denatures skin proteins. Thus it is a mild product with a good feel in use.

While the invention has been-described in detail and with reference to specific examples thereof, it will be apparent to one skilled in the art that various changes and modifications can be made therein without departing from the spirit and scope thereof.

What is claimed is:

1. A detergent composition comprising the following components (a) and (b), wherein the weight ratio of component (a) to component (b), (a)/(b), is from 0.1 to 20, the composition further contains divalent metal salt ions (X) and anionic surfactants (Y) wherein the molar ratio of the total divalent metal salt ions (X) in the entire composition to the total anionic surfactants (Y) including component (a), (X/Y), is from 0.025 to 10; wherein said composition contains component (z) in not more than 10% by weight based on the sum of the contents of the components (a) and (b):

(a) an amide ether carboxylate represented by the following formula (I):

(I)

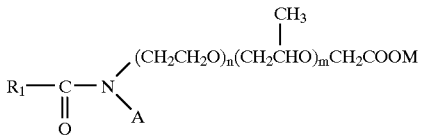

wherein $R_1$ represents a linear or branched alkyl or alkenyl group having 5 to 21 carbon atoms; n and m represent respectively the average number of moles of $(CH_2CH_2O)$ added and the average number of moles of

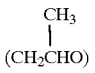

added and each represents a number of from 0 to 20, provided that they satisfy the formula $1 \leqq n+m \leqq 20$, and when m and n is respectively not 0, the copolymerization form of

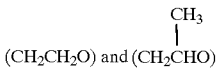

is random, block or alternating; A represents

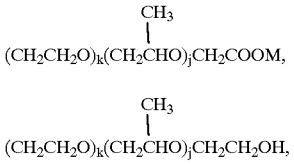

a hydrogen atom, or an alkyl group having 1 to 3 carbon atoms, wherein k and j each represents an average degree of polymerization of from 0 to 20, provided that they satisfy the formula $0 \leqq k+j \leqq 20$, and when k and j is respectively not 0, the copolymerization form of

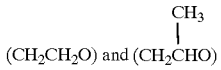

is random, block or alternating; M represents an alkali metal, an alkaline earth metal, ammonium, an alkanolammonium or a basic amino acid;

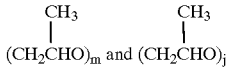

may represent respectively a propyleneoxy or a polypropyleneoxy group when m and j is respectively not 0, and the methyl group on the ethoxy unit can be bonded at the 2-position in place of the 1-position;

(b) an amide ether represented by the following formula (II):

(II)

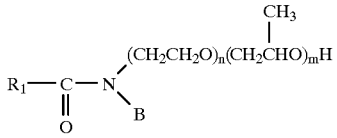

wherein B represents

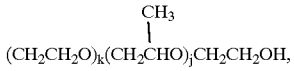

a hydrogen atom or an alkyl group having 1 to 3 carbon atoms, wherein $R_1$, n, m, k and j are each as defined above, and when m and n is respectively not 0, the copolymerization form of

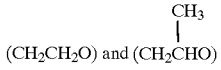

is random block or alternating, and in the above formulae (I) and (II), $R_1$, n, m, k and j may be either the same or different, and

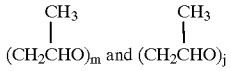

may represent respectively propyleneoxy or polypropyleneoxy group when m and j is respectively not 0, and the methyl group on the ethoxy unit can be bonded at the 2-position in place of 1-position; and (z) glycerol or a glyceryl ether represented by the following formula (III):

(III)

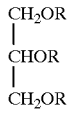

wherein R is the same or different and represents a hydrogen atom, $—(CH_2CH_2O)_pCH_2COOM$ or $—(CH_2CH_2O)_qH$ wherein p and q may be either the same or different and each represents a number of 1 to 20, and M represents a hydrogen atom, an alkali metal, an alkaline earth metal, ammonium or an alkanolammonium.

2. A detergent composition as claimed in claim 1 which further contains component (w) in not more than 10% by weight based on the sum of the contents of the components (a) and (b):

(w) a glyceryl ether represented by the following formula (IV):

(IV)

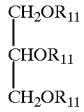

wherein $R_{11}$ represents a hydrogen atom,

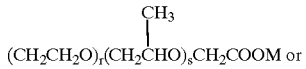

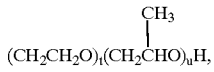

and three $R_{11}$s in a molecule may be either the same or different provided that three $R_{11}$s may not be hydrogen atoms simultaneously, wherein r, s, t and u each represents an umber which satisfy the formulae $s \neq 0$, $u \neq 0$, $1 \leqq r+s \leqq 20$ and $1 \leqq t+u \leqq 20$, the copolymerization form is random, block or alternating, and M represents a hydrogen atom, an alkali metal, an alkaline earth metal, ammonium, an alkanolammonium or a basic amino acid, and

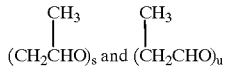

may represent respectively propyleneoxy or polypropyleneoxy group, and the methyl group can be bonded at the 2-position in place of 1-position of the ethoxy unit.

3. A detergent composition as claimed in claim 1 which further contains an amine oxide represented by the following (V) or (VI)

(V)

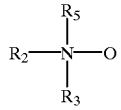

-continued (VI)

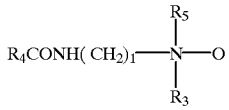

wherein $R_2$ represents an alkyl or alkenyl group having 8 to 22 carbon atoms; $R_5$ and $R_3$ may be either the same or different and each represents an alkyl or alkenyl group having 1 to 5 carbon atoms and optionally carrying hydroxyl group(s); $R_4$ represents an alkyl or alkenyl group having 7 to 21 carbon atoms; and 1 is a number of from 1 to 5.

4. A detergent composition as claimed in claim 1 or which further contains, one or more nonionic surfactants selected from the group consisting of (1) polyoxyethylene (average number of moles added: 2 to 15) alkyl or alkenyl (linear or branched, number of carbon atoms: 8 to 18) ethers; (2) fatty acid (number of carbon atoms: 8 to 18) monoethanolamides and fatty acid (number of carbon atoms: 8 to 18) diethanolamides; (3) sugar eater surfactants comprising monoalkyl ethers of fatty acids having 6 to 18 carbon atoms with monosaccharides having 5 to 6 carbon atoms and esters of fatty acids having 6 to 18 carbon atoms with sugars; and (4) sugar amides represented by the following formula (VII):

(VII)

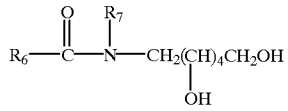

wherein $R_6$ represents an alkyl group having 5 to 17 carbon atoms; and $R_7$ represents a hydrogen atom or an alkyl group having 1 to 4 carbon atoms.

5. A detergent composition as claimed in claim 1 which further contains from 0.1 to 10% by weight of a linear or branched fatty acid salt having 5 to 23 carbon atoms.

6. A detergent composition as claimed in claim 1 which further contains, from 1 to 30% by weight of one or more anionic surfactants selected from among a group consisting of alkyl ($C_8$–$C_{18}$) sulfates, polyoxyethylene (average number of moles added: 1 to 10) alkyl ($C_8$–$C_{18}$) ether sulfates, linear alkyl ($C_8$–$C_{18}$) benzenesulfonates, α-olefine ($C_8$–$C_{18}$) sulfonates, alkane ($C_8$–$C_{18}$) sulfonates, α-sulfo fatty acid ($C_8$–$C_{18}$) methyl ester salts, polyoxyethylene (average number of moles added: 1 to 10) alkyl ($C_8$–$C_{18}$) ether acetates, alkyl ($C_8$–$C_{18}$) glyceryl ether sulfates, α-sulfo fatty acid ($C_8$–$C_{18}$) salts and polyoxyethylene glycol (average number of moles added: 1–10) α-sulfo fatty acid ($C_8$–$C_{18}$) ester salts.

7. A detergent composition as claimed in claim 1 which further contains an alkyl (number of carbon atoms: 8 to 18) glycoside.

8. A detergent composition as claimed in claim 1 wherein, in the above formula (I), A is a hydrogen atom and m is 0, while in the above formula (II), B is a hydrogen atom and m is 0.

9. A detergent composition as claimed in claim 1 wherein said weight ratio (a)/(b) is from 1 to 20 and said molar ratio (X/Y) is from 0.05 to 1.

10. A detergent composition as claimed in any of claim 1 to wherein said divalent metal salt ion in the above formula (I) Is a water soluble magnesium salt or a water soluble calcium salt or a mixture of both.

11. A detergent composition as claimed in claim 10 wherein said divalent metal salt is are one or more compounds selected from the group consisting of magnesium chloride, magnesium sulfate, magnesium iodide, magnesium nitrate, magnesium bromide, calcium chloride, calcium iodide, calcium bromide and calcium nitrate.

* * * * *